United States Patent [19]

Racine

[11] 4,398,638

[45] Aug. 16, 1983

[54] RACK FOR HOLDING SPOOLS

[76] Inventor: David E. Racine, 4822 Marathon Cir., Madison, Wis. 53705

[21] Appl. No.: 320,446

[22] Filed: Nov. 12, 1981

[51] Int. Cl.[3] ..... A47F 7/00

[52] U.S. Cl. ..... 211/60 R; 242/139; 312/72

[58] Field of Search ..... 211/71, 60 R, 14, 15, 211/13, 134; 242/134, 139, 137, 132, 141; 312/72, 73

[56] References Cited

U.S. PATENT DOCUMENTS

| | | | |
|---|---|---|---|
| 295,857 | 3/1884 | Collender | 211/15 |
| 296,136 | 4/1884 | Collender | 211/15 |
| 446,642 | 2/1891 | Gould | 242/137 UX |
| 1,832,850 | 11/1931 | Audino | 242/134 X |
| 3,473,756 | 10/1969 | Jones | 242/137 |

*Primary Examiner*—Ramon S. Britts
*Assistant Examiner*—Robert W. Gibson, Jr.
*Attorney, Agent, or Firm*—Isaksen, Lathrop, Esch, Hart & Clark

[57] ABSTRACT

A rack (10) for holding spools (24). The rack (10) has a frame (12) having a rear surface (20). A plurality of substantially horizontal, vertical arrayed shelf means (14) are supported by the frame (12). The shelf means (14) are adapted to hold a plurality of spools (24) in stable, end-to-end relation. The shelf means (14) are located forwardly from the rear surface (20) of the rack, leaving a space that extends upwardly behind all the shelf means (14) to form a spool passage (27). Spools (24) on the shelf means (14) may be thrust backwardly into the spool passage (27) where they fall to be caught by a collection tray (16) that is supported by the frame (12). The collection tray (16) extends forwardly under the shelf means (14). A spool (24) landing on the collection tray (16) may be grasped at the sides thereof and removed from the rack (10).

11 Claims, 4 Drawing Figures

RACK FOR HOLDING SPOOLS

TECHNICAL FIELD

The present invention relates to storage devices for sewing supplies in general, and in particular, to racks for storing spools of thread.

BACKGROUND OF PRIOR ART

The prior art is generally cognizant of racks or cases adapted to hold and exhibit spools of thread. For example, Cutler, U.S. Pat. No. 242,607, shows an exhibiting case for spools having drawers the bottom of which include side by side troughs or channels arranged in various ways to accept and hold spools. Williams, U.S. Pat. No. 1,182,827, shows a device for holding spools of thread in such a way that thread may be drawn from the spools without removing them from the cup-shaped shelves of the device. The prior art is also cognizant of devices in which identical packages or articles are stacked vertically and so held that the bottom-most article may be pushed backwardly off a shelf and fall down into a chute from which it may be removed, whereupon the entire stack of articles shifts downwardly to expose the next article to being so pushed off the shelf. An example of such device is shown in Compton, U.S. Pat. No. 2,474,142.

Certain problems not solved by the prior art are encountered in the storage of many spools holding material of diverse size, color, and texture, such as a working inventory of sewing threads, when the spools are to be arranged so that a user may readily select a desired spool and easily extract it from the holder. A vertical shelving unit might be selected wherein several shelves are arranged one above the other with the spools held end-to-end in a row that extends from one side of the holder to the other. By this arrangement, the thread of all the spools may be examined at a glance. An analogous arrangement is seen in Cutler. However, for a person to extract a spool from the holder, he must somehow grasp the spool. Thus, space for one's fingers must be left either at the ends of the spools or above them. If space is left at the ends, fewer spools may be stored on each shelf than would otherwise be the case. If headroom is left above each row of spools so that the user's finger may be inserted between the spool and the shelf next above, allowing him to pull the spool forward and off of the shelf, considerable space is wasted vertically. Therefore, when such an arrangement is employed, fewer spools may be stored in a given space than would be possible if they could be placed snugly end-to-end with little or no headroom above the spools and the next higher shelf.

BRIEF SUMMARY OF THE INVENTION

The present invention is summarized in that a rack for holding spools includes a frame having a rear surface. The rack also has a plurality of substantially horizontal, vertically arrayed shelf means for supporting a plurality of spools in stable, end-to-end relation. Each shelf means is supported by the frame and is located forwardly at a selected distance from the rear surface. The space extending from the rear surface forwardly to the most rearwardly projecting part of the shelf means and spools held thereon forms a spool passage. The spool passage extends upwardly behind all of the shelf means and is sufficiently deep at any given level to allow any spool stored at or above that level to freely move downwardly through the spool passage. The clearance above each shelf means is at least as great as the diameter of the largest spool to be supported thereby. A collection tray is supported by the frame and extends forwardly from the rear surface underneath the shelf means for a selected distance. The clearance between the collection tray and the lowermost shelf means is at least as great as the diameter of the largest spool to be held in the rack. A spool supported by a shelf means may be thrust backwardly off the shelf means to fall through the spool passage and come to rest on the collection tray, whereon the spool may be grasped at the sides thereof and removed from the rack.

A primary object of the invention is to provide a convenient and compact means for storing spools of thread.

A second object of the invention is to provide a means for storing spools of thread wherein the spools are arrayed in such a way that all spools stored can be clearly and easily seen with the threads exposed so that it is possible to hold a piece of material or the like in front of the spools to compare color and the like and readily find the closest possible match between material and thread without the necessity of removing the spools from the holder.

A further object of the invention is to provide such a holder for spools of thread in which the spools are held end-to-end in horizontal rows that are stacked vertically, one above the other.

Yet another object of the invention is to provide a holder for spools of thread from which it is possible to extract any single one of the spools without the necessity of leaving space at either end or above the spool to provide room for the user to insert a finger to grasp the spool.

Other objects, features, and advantages of the invention will be apparent from the following detailed description taken in conjunction with the accompanying drawings showing a preferred embodiment of a rack for holding spools exemplifying the principles of the invention.

DETAILED DESCRIPTION OF THE PREFERRED EMBODIMENT

Figure 1:
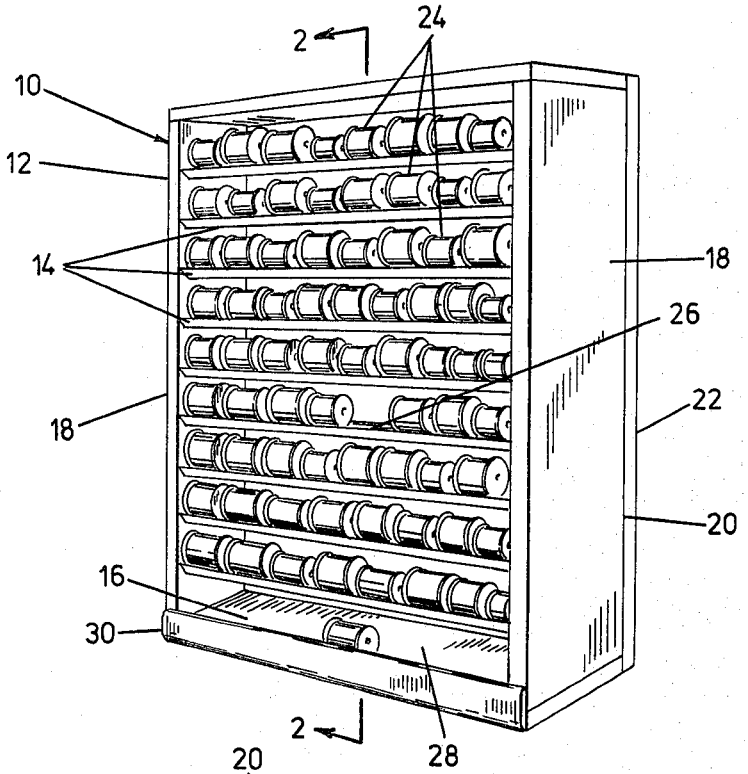
FIG. 1 is a perspective view of a rack for holding spools made in accordance with the invention.

Referring more particularly to the drawings, wherein like numbers refer to like parts, FIG. 1 illustrates a preferred embodiment of the novel rack for holding spools of the invention, shown generally at 10. The rack 10 has a frame 12, a plurality of shelf means 14 for supporting spools, and a collection tray 16.

The frame 12 of the preferred embodiment of the rack 10 has two, opposed side pieces 18 extending vertically for a selected distance. The frame 12 also has a rear surface 20. Preferably the rear surface 20 is substantially vertical. A back 22 is fastened to the rear surface 20, substantially covering the rear surface 20. The back 22 closes the space between the side pieces 18 and extends upwardly from the collection tray 16 at least to the level of the uppermost shelf means 14. The back 22 thus confines the spools 24, preventing them from moving rearwardly beyond the rear surface 20.

The shelf means 14 are substantially horizontal and are supported by the frame 12. In the preferred embodiment, they are supported by the side pieces 18. As many shelf means 14 as are desired may be located in a vertical array, one above the other. Alternatively, each shelf means 14 may be located above and slightly to the rear of the shelf means next below. The shelf means 14 are adapted to support a plurality of spools 24 in stable, end-to-end relation. In the preferred embodiment shown in FIGS. 1 and 2, each shelf means 14 has an upper curved surface defining an upwardly opening concavity 26 extending lengthwise along the shelf means. The curved concavity 26 has a radius at least as great as that of the largest spool 24 to be held therein. Thus, a spool placed therein will gravitate to the lowest point within the concavity 26 and be held stablely upon the shelf means 14. Each shelf means 14 is spaced forwardly away from the rear surface 20. The space extending from the rear surface 20 forwardly to the most rearwardly projecting part of the shelf means 14 and any spools 24 held thereon constitutes a spool passage 27, best shown in FIG. 2. The spool passage 27 extends upwardly behind all the shelf means 14 and is sufficiently deep at any given level to allow any spools stored at or above that level to freely move downwardly through the spool passage. The clearance above each shelf means 14 is at least as great as the diameter of the largest spool 24 to be supported thereby.

The collection tray 16 is supported by the frame 12. Preferably, the collection tray 16 is attached to the opposed side pieces 18. The collection tray 16 extends forwardly from the rear surface 20 underneath the shelf means 14 for a selected distance. The clearance between the collection tray 16 and the lowermost shelf means 14 is at least as great as, but preferably not much more than, the diameter of the largest spool 24 to be held in the rack 10. Preferably, the collection tray 16 has an upper surface 28 that slants slightly downwardly and away from the rear surface 20. A retaining bar 30 is attached to the collection tray 16 at a point remote from the rear surface 20. The retaining bar 30 extends for the length of the collection tray 16. The retaining bar 30 projects above the upper surface 28 of the collection tray 16 sufficiently far to prevent a spool 24 from rolling off the upper surface.

In use, the rack 10 for holding spools is filled with spools 24, the spools being placed end-to-end in the upwardly opening concavity 26 of each shelf means 14. So arranged, the thread on all of the spools 24 is clearly displayed, as can be appreciated by an examination of FIG. 1. A person desiring to select a particular thread can easily observe which spool 24 contains it. Furthermore, fabric and the like may be easily held in front of the rack 10 to be compared with the color or other characteristics of the thread held by the spools thereon to readily select the best match of thread to fabric without the need to remove any spools from the rack 10.

Figure 2:
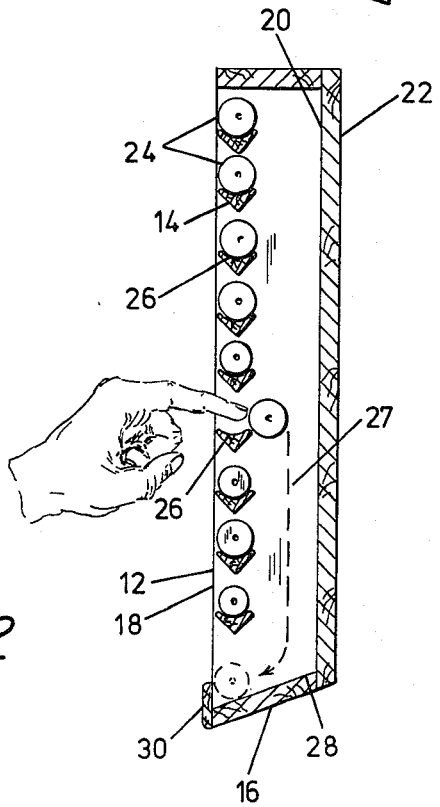
FIG. 2 is a section view of the rack for holding spools taken along section line 2—2 of FIG. 1.

When it is desired to remove a selected spool 24 from the rack 10, the spool may simply be pushed backwardly off the shelf means 14 toward the rear surface 20 by the finger of the user, as is illustrated in FIG. 2. The spool 24 will then drop through the spool passage 27 and land on the upper surface 28 of the collection tray 14. The spool 24 will then roll or slide forwardly on the slanted upward surface 28 until it comes to rest against the retaining bar 30. From this position, the spool 24 may be easily grasped between the fingers of the user and retrieved. Because spools 24 may be pushed backwardly and need not be grasped by a user and be drawn forwardly off the shelf means 14, the spools may be placed end-to-end on the shelf means with little or no space between them and little or no clearance between the spools and the shelf means next above. Consequently, more spools 24 can be stored within a given space than would otherwise be possible.

Although the preferred embodiment of the invention includes a back 22, it will be readily appreciated that the back may be omitted. The frame 12 may be adapted to be attached to a wall or any other flat surface, which surface will then function as does the back 22 of the preferred embodiment shown at 10 to confine the spools 24 as they fall. Moreover, so long as the spool passage 27 is sufficiently deep, even with no back 22 or other confining surface such as a wall, a spool 24 pushed off a shelf means 14 in the manner described above will fall downwardly to land in the collection tray 16. If the upper surface 28 of the collection tray 16 extends slightly downwardly and forwardly from the rear surface 20, in the manner described above, the resulting slant to the surface will prevent the spool 24 from bouncing backwardly and out of the rack 10.

Figure 4:
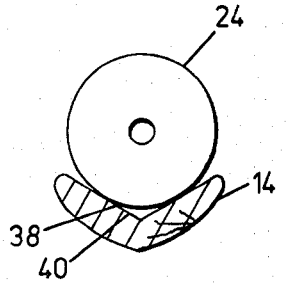
FIG. 4 is a view comparable to that of FIG. 2 of a third embodiment of the shelf means of the invention.
Figure 3:
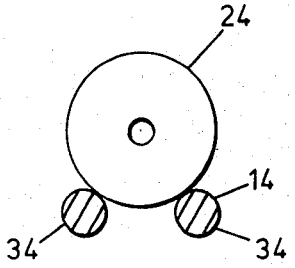
FIG. 3 is a view comparable to that of FIG. 2 of a second embodiment of the shelf means of the invention.

The particular embodiment of the shelf means 14 for supporting spools that was described above has an upwardly opening concavity 26. However, any alternative shelf means 14 adapted to hold spools in end-to-end relation and to prevent their rolling forwardly or backwardly off the shelf means is within the scope and spirit of the invention. A first alternative embodiment of the shelf means 14 is shown in FIG. 3 and includes two parallel rods 34 extending between the side pieces 18. The rods 34 are spaced from each other at a distance less than the diameter of the smallet spool 24 to be supported thereby. A spool 24 placed on the rods 34 will extend downwardly between them for a slight distance dependent upon the diameter of the spool to stablely remain in that position until pushed backwardly by the finger of the user. A second alternative embodiment of the shelf means 14 is shown in FIG. 4. The second alternative embodiment of the shelf means 14 has substantially flat upper surfaces 38 intersecting to form an upwardly facing, vee-shaped channel 40 extending for substantially the length of the shelf means. A spool 24 placed in a channel 40 and extending lengthwise therein will be stablely supported by the upwardly facing flat surfaces 38 until forced off by the finger of the user, in the manner described above.

The parts of the rack 10 for holding spools may each be made from wood, plastic, metal, or any other suitable, rigid material. The various parts of the rack of the invention may be formed by conventional techniques for cutting or forming the materials referred to above.

It is understood that the invention is not confined to the particular construction, materials, and arrangement of parts herein illustrated and described, and that various changes may be made without departing from the spirit of the invention. The invention embraces all such modified forms thereof as come within the scope of the following claims.

What is claimed is:

1. A rack (10) for holding spools (24) comprising:

(a) a frame (12) having a rear surface (20);

(b) a plurality of substantially horizontal, vertically arrayed shelf means (14) for supporting a plurality of spools (24) in stable, end-to-end relation, each shelf means (14) supported by the frame (12) and located forwardly at a selected distance from the rear surface (20), the space extending from the rear surface (20) forwardly to the most rearwardly projecting part of the shelf means (14) and spools (24) held thereon forming a spool passage (27) that extends upwardly behind all the shelf means (14), the spool passage (27) being sufficiently deep at any given level to allow any spool (24) stored at and above that level to freely fall downwardly through the spool passage (27), the clearance above each shelf means (14) being at least as great as the diameter of the largest spool (24) to be supported thereby; and (c) a collection tray (16) supported by the frame (12) extending forwardly from the rear surface (20) underneath the shelf means (14) for a selected distance, the clearance between the collection tray (16) and the lowermost shelf means (14) being at least as great as the diameter of the largest spool (24) to be held in the rack (10), so that a spool (24) supported by a shelf means (14) may be thrust backwardly off the shelf means (14) to fall through the spool passage (27) and come to rest on the collection tray (16), whereon the spool (24) may be grasped at the sides thereof and removed from the rack (10).

2. The rack (10) of claim 1 including a back (22) attached to the rear surface (20) and extending from the collection tray (16) upwardly for a selected distance.

3. The rack (10) of claim 1 wherein the frame (12) has side pieces (18) and the shelf means (14) extend therebetween and are supported thereby.

4. The rack (10) of claim 1 wherein the collection tray (16) has a floor (28) inclined downwardly and extending forwardly from the back surface (20), and a retaining bar (30) projecting upwardly from the forwardmost portion of the floor (28) and extending substantially the length of the floor (28), so that a spool (24) coming to rest on the collection tray (16) will tend to roll forwardly on the floor (28) and come to rest against the retaining bar (30).

5. The rack (10) of claim 1, 2, 3, or 4 wherein the shelf means (14) has an upwardly opening concavity (26) extending lengthwise relative to the shelf means (14) and adapted to retain spools (24) placed therein.

6. The rack (10) of claim 1, 2, 3, or 4 wherein the shelf means (14) has an upwardly opening, vee-shaped channel (40) extending lengthwise relative to the shelf means (14) and adapted to retain spools placed therein.

7. The rack (10) of claim 1, 2, 3, or 4 wherein the shelf means (14) includes at least two, parallel rods (34) extending horizontally for the length of the shelf means (14) and separated by a distance less than the diameter of the smallest spool (24) to be retained on the shelf means (14).

8. The rack (10) of claim 3 or 4 including a back (22) attached to the rear surface (20) and extending from the collection tray (16) upwardly for a selected distance.

9. The rack (10) of claim 2 or 4 wherein the frame (12) has side pieces (18) and the shelf means (14) extend therebetween and are supported thereby.

10. The rack (10) of claim 2 or 3 wherein the collection tray (16) has a floor (28) inclined downwardly and extending forwardly from the back surface (20) and a retaining bar (30) projecting upwardly from the forwardmost portion of the floor (28) and extending substantially the length of the floor (28), so that a spool (24) coming to rest on the collection tray (16) will tend to roll forwardly on the floor (28) and come to rest against the retaining bar (30).

11. A rack (10) for holding spools (24) comprising:

(a) a frame (12) having side pieces (18) having a rear surface (20), and a back (22) attached to the rear surface (20) and substantially closing the space between the side pieces (18);

(b) a plurality of substantially horizontal, vertically arrayed shelf means (14) for supporting a plurality of spools (24) in stable, end-to-end relation, each shelf means (14) extending between and supported by the side pieces (18) and spaced forwardly from the rear surface (20), the space extending from the rear surface (20) forwardly to the most rearwardly projecting part of the shelf means (14) and any spools (24) held thereon forming a spool passage (27) that extends upwardly behind all the shelf means (14), the spool passage (27) being sufficiently deep at any given level to allow any spool (24) stored at and above that level to freely move downwardly through the spool passage (27), the clearance above each shelf means (14) being at least as great as the diameter of the largest spool (24) to be supported thereby; and (c) a collection tray (16) supported by the frame (12), extending forwardly from the rear surface (20) underneath the shelf means (14) for a selected distance and having a floor (28) inclined downwardly and extending forwardly from the back surface (20), the clearance between the floor (28) and the lowermost shelf means (14) being at least as great as the diameter of the largest spool (24) to be held in the rack (10), so that a spool (24) supported by a shelf means (14) may be thrust backwardly off the shelf means (14) to fall through the spool passage (27) to land on the floor (28) of the collection tray (16) and roll and slide forwardly on the floor (28), whereon it may be grasped at its sides and removed from the rack (10).

* * * * *